United States Patent [19]

Gibson

[11] 4,057,036

[45] Nov. 8, 1977

[54] ROTARY ENGINE WITH VARIABLE ORIFICE PRECHAMBER

[75] Inventor: Myron R. Gibson, Edelstein, Ill.

[73] Assignee: Caterpillar Tractor Co., Peoria, Ill.

[21] Appl. No.: 662,500

[22] Filed: Mar. 1, 1976

[51] Int. Cl.[2] ..... F02B 53/10

[52] U.S. Cl. ..... 123/8.09

[58] Field of Search ..... 123/8.09, 8.11, 8.13

[56] References Cited

U.S. PATENT DOCUMENTS

| | | | |
|---|---|---|---|
| 3,283,750 | 11/1966 | Löhner | 123/8.11 |
| 3,508,530 | 4/1970 | Clawson | 123/8.13 X |
| 3,857,369 | 12/1974 | Sabet | 123/8.13 |
| 3,954,088 | 5/1976 | Scott | 123/8.11 |
| 3,957,021 | 5/1976 | Loyd | 123/8.11 |

*Primary Examiner*—Carlton R. Croyle
*Assistant Examiner*—Michael Koczo, Jr.
*Attorney, Agent, or Firm*—Wegner, Stellman, McCord, Wiles & Wood

[57] ABSTRACT

An improved rotary engine including a housing having walls defining an operating chamber, a prechamber within the housing, an opening in one of the walls establishing fluid communication between the chamber and the prechamber, and means for introducing fuel into the prechamber. A shaft is journalled in the housing and extends through the chamber while a rotor is journalled on the shaft and within the chamber. The rotor has a surface cyclically brought into proximity with the wall including the opening and the opening therein for cyclically compressing an oxygen-containing medium within the prechamber. Means, including a portion of the surface, are employed for varying the effective size of the opening to thereby control the flow of combustion gases from the prechamber to the chamber at a desired rate to achieve a desired combustion characteristic.

2 Claims, 4 Drawing Figures

ROTARY ENGINE WITH VARIABLE ORIFICE PRECHAMBER

BACKGROUND OF THE INVENTION

This invention relates to rotary engines and, more specifically, to the provision of a variable orifice prechamber in such engines.

Prior art of relevance includes U.S. Pat. No. 3,738,332 issued June 12, 1973 to Eyzat et al.

It has been known to provide a variable orifice prechamber in reciprocating engines to achieve certain advantages. Included in the advantages is that wherein, during initial stages of combustion, high turbulence and low ignition lag are achieved. Another advantage is that, while in the later stages of combustion, the engine acts much like a direct injection engine having good fuel economy and low heat rejection characteristics.

Generally, these advantages are achieved by regulating the rate of exit of combustion gases from the prechamber so as to cause the combustion process to take place at substantially constant pressure and at a rate approaching that of the theoretical ideal, all as discussed in the previously identified Eyzat et al patent.

Eyzat et al achieve the foregoing characteristics in a structure wherein an opening interconnecting a cylinder and a prechamber is opened at a desired rate by a protrusion carried on a reciprocal piston. Quite obviously, this approach cannot be employed in rotary engines wherein rotary pistons do not move reciprocally, but rather, undergo both rotational and translational movement.

SUMMARY OF THE INVENTION

It is the principal object of the invention to provide a new and improved rotary engine. More specifically, it is an object of the invention to provide a rotary engine including a variable orifice prechamber.

An exemplary embodiment of the invention achieves the foregoing object in a structure including a housing having walls defining an operating chamber, a prechamber within the housing, an opening in one of the walls establishing fluid communication between the chamber and the prechamber, and means for introducing fuel into the prechamber. A shaft is journalled in the housing and extends through the chamber. A rotor is journalled on the shaft and within the housing and has a surface cyclically brought into proximity with the one wall including the opening and the opening therein for cyclically compressing an oxygen-containing medium within the prechamber. Means are provided, including a portion of the rotor surface, for varying the effective size of the opening to thereby control the rate of flow of combustion gases from the prechamber to the chamber at a desired rate.

In a highly preferred embodiment, the control means include a control recess in the rotor surface located to pass the opening from the prechamber during engine operation at about, or subsequent to, maximum compression of the oxygen-containing medium and having a configuration such that the flow of combustion gases from the prechamber into the operating chamber is controlled by the shape of the rotor surface about the recess in the proximity of the rotor surface and the recess to the opening to the predetermined desired rate.

In a highly preferred embodiment, there is provided an additional recess in the rotor surface separate from the control recess and located to permit free entry of the medium into the opening prior to maximum compression and a portion of the rotor surface between the recesses substantially closes the opening at maximum compression.

Other objects and advantages will become apparent from the following specification taken in connection with the accompanying drawings.

DESCRIPTION OF THE PREFERRED EMBODIMENT

Figure 1:
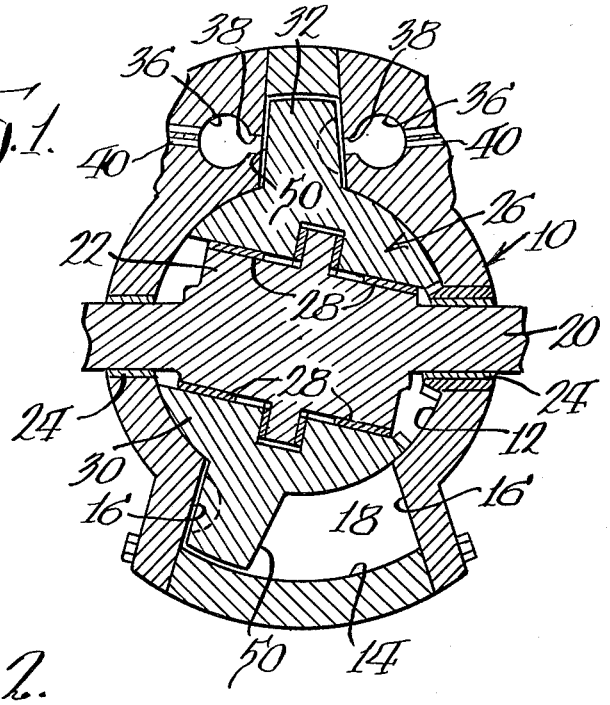
FIG. 1 is a sectional view of a rotary engine, specifically a slant axis rotary engine, embodying the invention.

An exemplary embodiment of an engine made according to the invention is illustrated in FIG. 1 in the form of a four-cycle, slant axis rotary engine. However, it is to be understood that the principles of the invention are applicable to rotary engines other than slant axis rotary engines as, for example, epitrochoidal and hypotrochoidal engines as well. Moreover, the principles of the invention are applicable to engines operating on numbers of cycles other than four.

The engine includes a housing, generally designated 10, having a radially inner spherical wall 12, a radially outer spherical wall 14 and interconnecting, generally radially extending, opposed side walls 16. As is well known, in a four-cycle slant axis rotary mechanism, the walls 16 will have a conical and generally sinusoidal configuration.

The walls 12, 14 and 16 define an operating chamber 18. A shaft 20 having an angularly offset portion or eccentric 22 is journalled by bearings 24 within the housing 10 so as to extend through the operating chamber 18. A rotor, generally designated 26, is journalled on the eccentric 22 by bearings 28 and includes a generally spherical hub 30 and a peripheral, radially outwardly extending flange 32.

The flange 32 is configured to have three apices on each side thereof with the apices on one side being staggered with respect to the apices on the other. Various seals are carried both by the flange and by the spherical hub 30, as is well known, including peripheral seals engaging the radially outer spherical wall 14, hub seals engaging the radially inner spherical wall 12, and apex seals engaging a respective one of the end walls 16.

As is well known, in a slant axis rotary mechanism, combustion occurs on both sides of the flange 32 of the rotor 26 and in accordance with the present invention, at the area of maximum compression, there is provided a pair of prechambers 36, one for each side of the flange 32. Each prechamber 36 includes a respective opening 38 in the associated end wall 16 opening to the operating chamber to establish fluid communication therebetween. In addition, means, such as a conventional fuel injector 40, are provided for injecting fuel into each of the prechambers 36.

Figure 2:
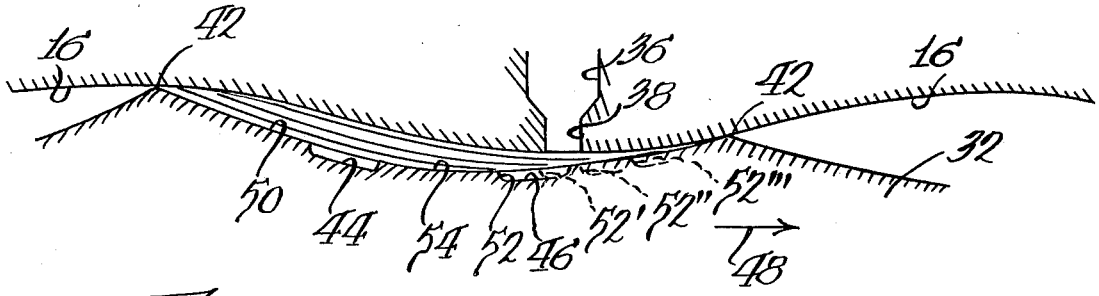
FIG. 2 is an enlarged, fragmentary, somewhat schematic, developed view illustrating the relation of a portion of a rotor surface to a wall of an operating chamber in the engine and a prechamber associated therewith at several stages of operation of the engine.
Figure 3:
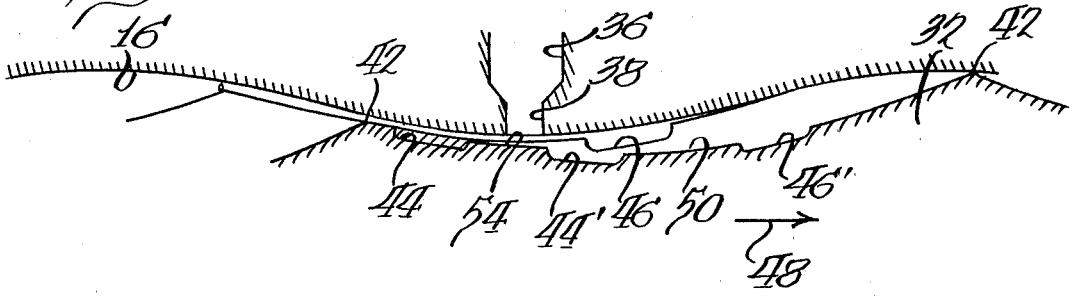
FIG. 3 is a view similar to FIG. 2 illustrating the relationship of the components at subsequent stages of operation of the engine.
Figure 4:
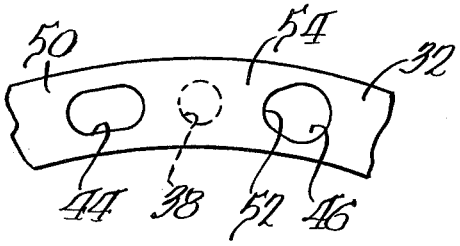
FIG. 4 is a fragmentary, somewhat schematic view of a portion of the rotor.

Turning now to FIGS. 2–4, inclusive, the rotor flange 32 between each of the apices 42 thereon is seen to be provided with a control recess 44 and an additional recess 46 which are separate and spaced from each other. The intended movement of the rotor is indicated by an arrow 48 and, as can be seen, the recess 46 precedes the recess 44 past the opening 38.

More particularly, the recess 46 is located so as to permit relatively free flow of a combustion supporting medium through the opening 38 into the prechamber 36 before maximum compression of the medium is attained. For example, FIG. 2 illustrates with hatching, the relative configuration of the components at approximately 60° of rotor rotation past that whereat compression would be at a minimum. Those skilled in the art will realize that prior to the attainment of the configuration of components illustrated in FIG. 2, the side surface 50 of the rotor in which the recesses 44 and 46 are formed would be sufficiently spaced from the end wall 16 so that, as compression was initiated, free flow of the medium into the prechamber 36 would occur.

As rotation of the rotor 48 continues, the surface 50 gradually moves to closer and closer proximity to the opening 38 thereby interfering, progressively, with the free flow of gas into and out of the opening 38. Since such interference obviously impedes the efficiency of operation of the engine, it is to be minimized and the recess 46 is provided for that purpose. Specifically, the presence of the recess 46 permits relatively free flow of fluid into the prechamber 36 at points just prior to that whereat maximum compression is attained. This is achieved by locating the trailing edge 52 of the recess 46 such that it will pass the opening 38 at a point just prior to so-called "top dead center".

As a consequence of the foregoing, an island 54 or portion of the surface 50 between the recesses 44 and 46 will substantially block the opening 38 when top dead center is reached, as illustrated by the unhatched showing of FIG. 3 and the fragmentary showing of FIG. 4 with the opening 38 superimposed thereon in dotted lines. For clarity of illustration, FIG. 2 also illustrates the sequential position of the trailing edge 52 of the recess 46 with primed characters and in dotted lines.

In a typical operating cycle, fuel will be injected into the desired one of the prechambers 36 at or about top dead center and the ignition process will begin. At or about the beginning of the initiation of the ignition process, usually at about or subsequent to the attainment of top dead center, that is, maximum compression, it is desired that the rate of flow of the combustion gases from the prechamber 36 to the operating chamber be controlled as, for example, to achieve constant pressure operation. This is achieved by the presence of the control recess 44 which is located to have an edge thereof overlap a portion of the periphery of the opening 36 at the desired point in time. As rotor rotation 48 continues, a greater and greater portion of the opening 38 will be exposed by the recess 44 allowing greater and greater flow rates.

As a consequence, by suitably configuring the recess 44, the flow rate during a combustion process can be regulated throughout to attain desired performance requirements depending upon such factors as angular velocity, power output, emission control, peak pressure, etc.

As the rotor continues to move in the direction of the arrow 48, the surface 50 thereof will continue to move away from the end wall 16 until such time as relatively free flow from the opening 38 is present at which time the engine will operate very similarly to a direct injection engine and possess the advantages thereof.

From the foregoing, it will be appreciated that an engine made according to the invention possesses all the advantages of reciprocating engines employing variable orifice prechambers with a simple and economical construction. As mentioned, the principles can be employed in so-called Wankel type engines (epitrochoidal engines) as well as hypotrochoidal and modified hypotrochoidal engines. In engines of the latter category, the invention can be employed with great effectiveness inasmuch as the same are constructed so that the rotor will theoretically touch the housing at its waist or in the immediate vicinity at virtually all times of the operating cycle. Thus, by locating the opening from the prechamber at the waist of such a mechanism, gas flow can be controlled at all times through the provision of a relatively narrow recess having its sides configured to provide the desired gas flow rate.

What is claimed is:

1. In a rotary engine, the combination comprising:
   - a housing having walls defining an operating chamber;
   - a prechamber associated with said housing;
   - an opening in one of said walls establishing fluid communication between said chamber and said prechamber;
   - means for introducing fuel into said prechamber;
   - a shaft journalled in said housing and extending through said chamber;
   - a rotor journalled on said shaft within said chamber and having a surface cyclically brought into proximity with said one wall and said opening for cyclically compressing an oxygen containing medium within said prechamber;
   - a control recess in said surface located to pass said opening during engine operation at about or subsequent to maximum compression of said medium and having a configuration such that the flow of combustion gases from said prechamber into said operating chamber is controlled by the shape of said surface about said recess and the proximity of said surface and said recess to said opening at a predetermined, desired rate; and
   - an additional recess in said surface separate from said control recess, and located to permit free entry of said medium into said opening prior to maximum compression of said medium.

2. The rotary engine of claim 1 wherein a portion of said surface between said recesses substantially closes said opening at maximum compression of said medium.

* * * * *